US007569786B2

(12) United States Patent
Spies

(10) Patent No.: US 7,569,786 B2
(45) Date of Patent: Aug. 4, 2009

(54) ACTUATOR FOR AN ELECTRIC PUSH-BUTTON SWITCH, PARTICULARLY IN VEHICLES

(75) Inventor: Wolfgang Uwe Spies, Haan (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 277 days.

(21) Appl. No.: 10/589,166

(22) PCT Filed: Jan. 18, 2005

(86) PCT No.: PCT/EP2005/000413

§ 371 (c)(1),
(2), (4) Date: Aug. 11, 2006

(87) PCT Pub. No.: WO2005/081274

PCT Pub. Date: Sep. 1, 2005

(65) Prior Publication Data

US 2007/0164611 A1 Jul. 19, 2007

(30) Foreign Application Priority Data

Feb. 12, 2004 (DE) ..... 10 2004 006 939

(51) Int. Cl.
*H01H 9/26* (2006.01)

(52) U.S. Cl. ..... 200/339; 200/5 R

(58) Field of Classification Search ... 200/302.1–302.3, 200/5 R, 17 R, 339, 553
See application file for complete search history.

(56) References Cited

U.S. PATENT DOCUMENTS 4,739,127 A * 4/1988 Higuchi et al. ..... 200/5 R
5,426,275 A * 6/1995 Maeda et al. ..... 200/553
5,655,650 A * 8/1997 Naitou ..... 200/553
5,693,920 A * 12/1997 Maeda ..... 200/1 B
5,744,765 A * 4/1998 Yamamoto ..... 200/6 A
6,963,039 B1 * 11/2005 Weng et al. ..... 200/302.1

FOREIGN PATENT DOCUMENTS

DE 34 05 654 8/1985
DE 100 20 172 1/2001

* cited by examiner

*Primary Examiner*—Michael A Friedhofer
*Assistant Examiner*—Lisa N Klaus
(74) *Attorney, Agent, or Firm*—Friedrich Kueffner

(57) ABSTRACT

The invention relates to an actuator for an electric push-button switch (30) comprising a housing shell (10) in whose shell opening (13) a holding plate (20) is placed. A holding suspension, together with outer stops (21) and outer counterstops (11) between the holding plate (20) and the holding housing permit the non-actuated holding plate (10) to be pressed into a defined outer position of rest (20.1). A push-button switch (30), which is arranged in the housing shell (10), is, together with its switching element (31), located in an extended position (30.1) that is effected by a switch suspension (33). The aim of the invention is to provide an economical space-saving design. To this end, the switch suspension (33) of the push-button switch (30) is simultaneously provided with the function of providing the holding suspension of the holding plate (20). Inner stops and inner counterstops are also provided between the holding plate (20) and the housing shell (10) and, in the event of an asymmetrical actuation, ensure a defined inclined position of the holding plate (20). This controlled inclined position ensures that the switching element (31) of the push-button switch (30) reaches, even in this event, a contact-effective depressed position.

27 Claims, 3 Drawing Sheets

FIG. 4
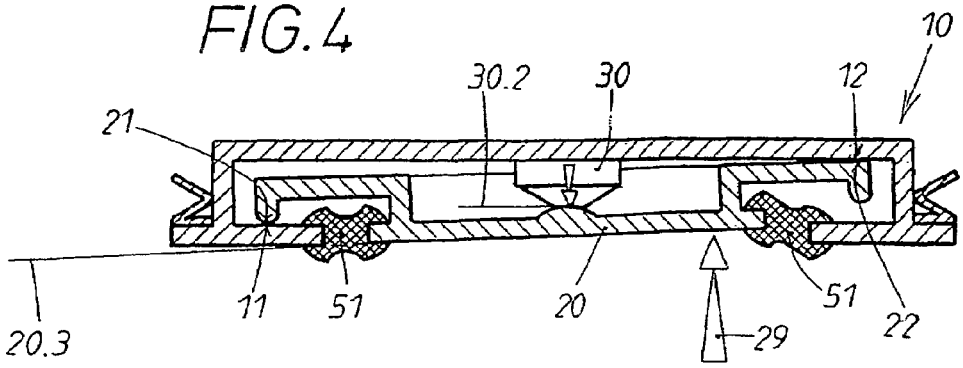
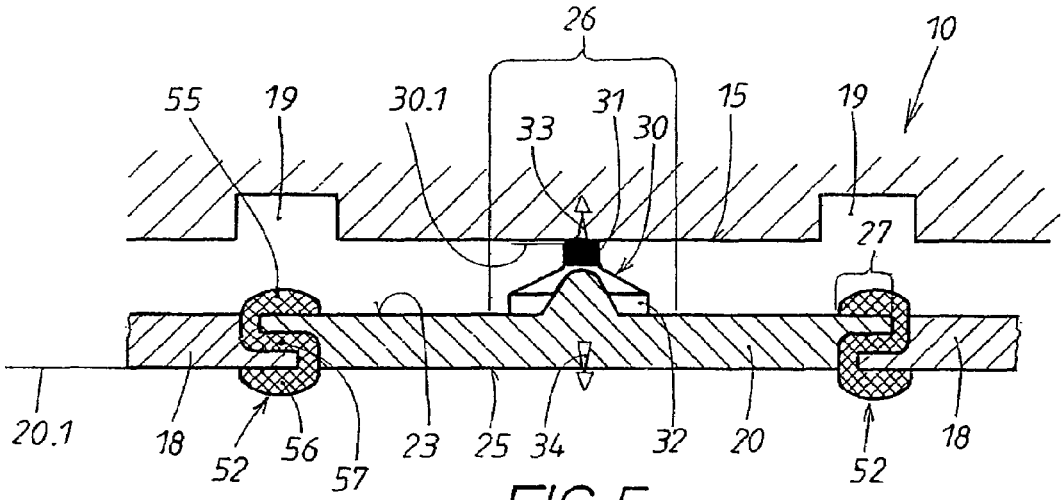
FIG. 5
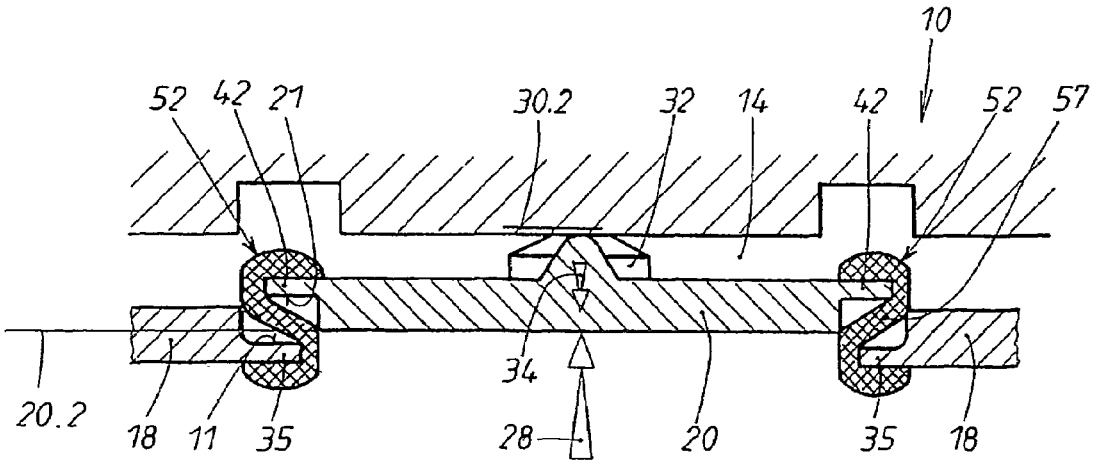
FIG. 6

ACTUATOR FOR AN ELECTRIC PUSH-BUTTON SWITCH, PARTICULARLY IN VEHICLES

The invention concerns an actuator for an electric push-button switch. Actuators of this type are used in vehicle doors or vehicle hatches. If the handle plate is actuated, the switching element is moved into a depressed position, in which the contacts in the push-button switch enter a switching position, in which they can reswitch a lock on the vehicle door or hatch. The vehicle door or hatch is then released and can be opened.

In previously known actuators of this type (DE 100 20 172 A1), special springs are installed inside the housing shell, which act as a handle suspension and keep the handle plate pushed back in an outer rest position, which is determined on one side by outer stops on the handle plate and on the other side by outer opposing stops on the housing plate. A handle suspension of this type consists either of leaf springs that are mounted on the inner walls of the housing shell and press against the rear side of the handle plate or of leaf springs that are seated on the rear side of the handle plate and are supported on stationary supports inside the housing shell. A handle suspension of this type and its points of application require additional components and above all space in the interior of the housing shell, which is then no longer freely available for other important components. Another disadvantage of the previously known actuator is that, when it is operated unsymmetrically, the handle plate tilts out of line and then no longer guarantees reswitching of the switching element by the push-button switch; in this case, the contacts in the push-button switch no longer move into the desired second position.

In addition, a push-button switching assembly is known (DE 197 37 907 A1), in which an operating rocker plate with locking hooks and a base with opposing catches are mounted by snapping together. The rocker plate has an operating cam, which, when actuated, acts on a microswitch. The restoring force inherent in the microswitch is used to restore the operating rocker plate to its neutral position.

Finally, a printed circuit board push-button switch is known (DE 37 28 166 C2), in which the printed circuit board has recesses, which are penetrated by anchor pins of a cap that serves as a handle. The area of the printed circuit board that lies between the recesses acts as a switch; it has two electric contacts, which is covered by an arched, monostable diaphragm. The diaphragm consists of an electrically conductive material. When the cap is operated, pressure beads located on the underside of the cap press the diaphragm into a flattened position, in which the contacts in the printed circuit board are electrically connected with one another. Stops, which are located at the free ends of the anchor pins, engage a lateral hollow of the aforesaid recess. When pressure is applied to the cap eccentrically, these stops prevent the cap from lifting from the printed circuit board on the opposite side. This is intended to allow the push-button switch to switch reliably, even in the case of off-center actuation.

The objective of the invention is to develop a reliable, space-saving and inexpensive actuator. This objective is achieved by a construction in which the switch suspension of the push-button switch is simultaneously the handle suspension for the handle plate, which causes the unactuated handle plate to be held by the switch suspension of the push-button switch in its outer rest position, in which the outer stops of the handle plate rest on the outer opposing stops of the housing shell. The handle plate has inner stops and the housing shell has inner opposing stops, which, when the handle plate is unsymmetrically actuated, cause the handle plate to assume an inclined position in such a way that the switching element of the push-button switch is nevertheless moved by the handle plate into its depressed effective contact position.

In the invention, the switch suspension of the push-button switch takes on the new function of simultaneously providing the handle suspension for the handle plate. This eliminates the additional components of the handle suspension that would otherwise be needed, and the space previously required for this is available for other important purposes in the actuator of the invention. This allows a more compact design of the actuator of the invention. The handle plate can be designed with a larger area than in prior-art designs and can have, for example, a square or rectangular shape. If a handle plate of this type is actuated at its edges instead of in the center, which leads to an unsymmetrical tilted position of the handle plate in the housing shell, inner stops on the handle plate, on the one hand, and inner opposing stops on the housing shell, on the other hand, provide control of the handle plate in such a way that the switching element of the push-button switch reliably enters its depressed effective contact position. Therefore, the reswitching of the contacts into the second switching position is also ensured in this case. Incorrect actuation of the actuator of the invention is thus prevented.

Additional features and advantages of the invention are specified in the following description and are schematically illustrated in the drawings, which show several specific embodiments of the invention.

FIG. 4 shows the actuator of FIG. 1 when its handle plate has been unsymmetrically actuated and has assumed an inclined position.

FIG. 5 shows a second embodiment of an actuator of the invention with the handle plate in its rest position.

FIG. 6 shows the actuator of FIG. 5 when the handle plate has been symmetrically actuated and is in its operative position.

The following analogous parts are provided with the same reference numbers, even when they have different designs from case to case.

Figure 1:
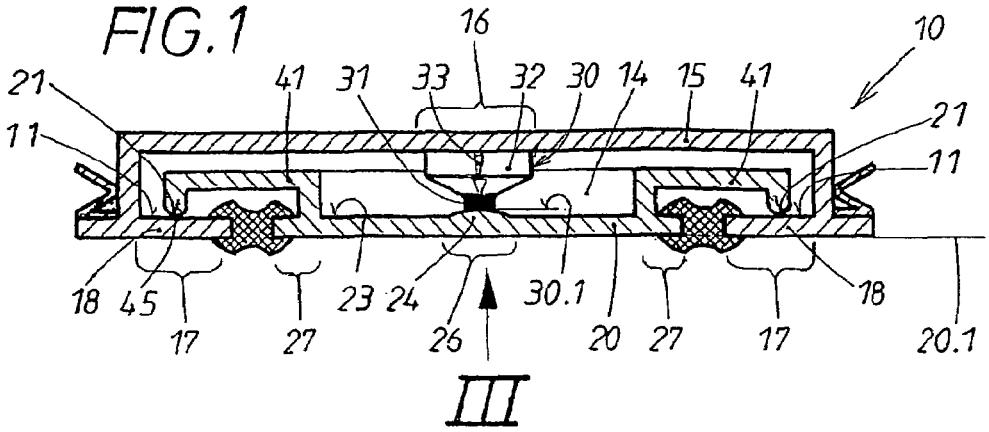
FIG. 1 shows a cross section through a first embodiment of an actuator of the invention with its handle plate in its rest position.

A housing shell 10 is provided. A handle plate 20 is mounted in the shell opening 13. An electric push-button switch 30 is mounted in the shell interior 14. Its inputs are connected to a power source (not shown). The outputs of the push-button switch lead to a functional device, e.g., a vehicle lock. The push-button switch 30 has a pressure-operated switching element 31, which is acted on by a switch suspension 33, as illustrated by an arrow. This switch suspension 33 strives to keep the switching element 31 pushed out in the extended position shown in FIG. 1, as indicated in the drawings by an auxiliary line 30.1. In other respects, there are the following differences among the various embodiments of the invention.

In the case of FIG. 1, the push-button switch 30 with its switch housing 32 is mounted essentially in the center 16 of the shell base 15, and its switching element 31 is supported on the rear side 23 of the handle plate 20. In this regard, it is advisable to provide a prominence 24 with a spherical profile in the center 26 of the rear side 23 of the plate. This prominence 24 fits into a corresponding recess at the end of the switching element. The latter feature results in a sort of ball-and-socket contact between the switching element 31 and the rear side 23 of the plate. A crucial feature is that the switch suspension 33 acts as a suspension of the handle plate 20 and strives to keep the handle plate 20 in its rest position shown in FIG. 1, as indicated by the auxiliary line 20.1 in FIG. 1.

Figure 2:
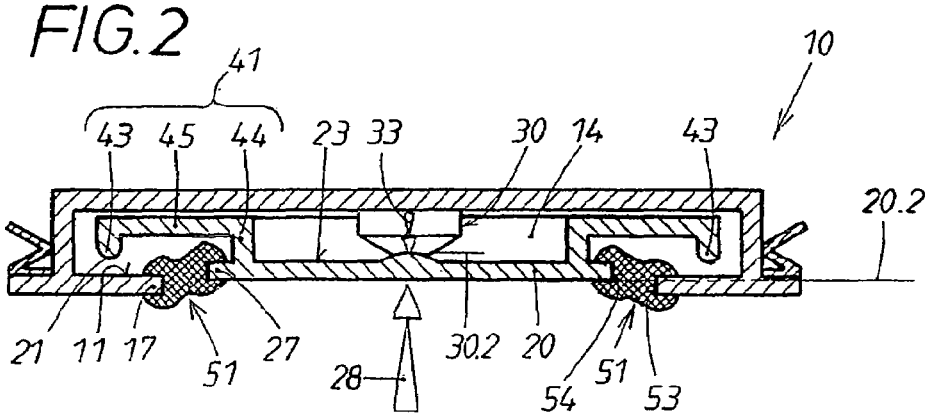
FIG. 2 shows the actuator of FIG. 1 when the handle plate has been symmetrically actuated and has reached an operative position inside the housing shell.
Figure 3:
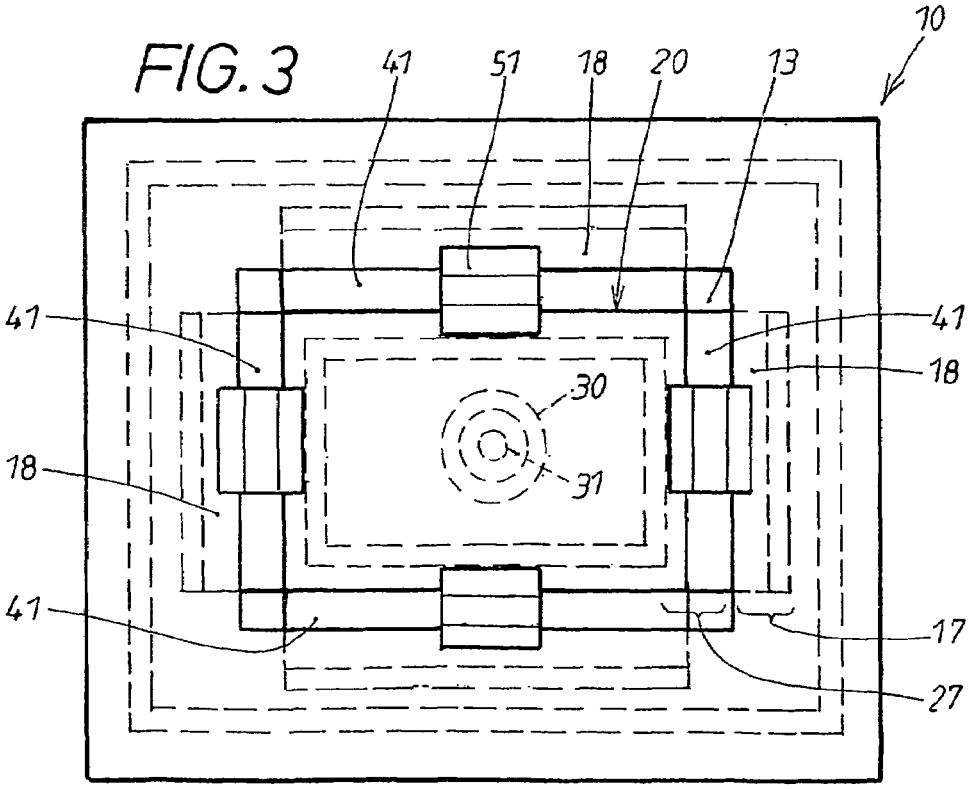
FIG. 3 shows a top view of the actuator of FIG. 1, as viewed in the direction of arrow III in FIG. 1.

In the embodiment of FIGS. 1 to 4, paired extensions in the form of U-shaped sections are placed on the rear side 23 of the plate in opposite edge regions 27 of the handle plate 20. These extensions 41 are overlapped on the visible side by strips 18 arranged in the edge region 17 of the shell opening 13. As FIG. 2 shows, each U-shaped extension consists of an outer U-sidepiece 43 and an inner U-sidepiece 44, which are joined by a U-crosspiece 45. Due to the switch suspension 33, the rest position 20.1 of the handle plate 20 is determined by virtue of the fact that the outer U-sidepiece 43 of each U-shaped extension 41 is supported on the inner, housing-side surface of the marginal strips 18. The ends of the U-sidepieces then each constitute an outer stop 21, and the inner surfaces of the strips then constitute the associated outer opposing stops 11.

As FIG. 2 illustrates, in the first embodiment of the invention, joint members 51 are also arranged between the edge 27 of the plate and the edge 17 of the of the housing. In the present case, they consist of an elastomeric material and have the form of a web. This web 51 is attached at one end to the edge 27 of the plate and at the other end to the edge 17 of the opening, which can be accomplished by injection. In the present case, the two ends of the web are provided with recesses 53, 54, into which the edges 53, 54 fit on either side, as FIG. 2 illustrates.

FIG. 2 shows the case in which a symmetrical manual actuation is carried out, as indicated by the actuation arrow 28. The handle plate 20 is pushed into the shell interior 14 against the switch suspension 33. Due to the aforementioned rear-side support, the switching element 31 is then also pushed in and moves into its depressed position indicated by the auxiliary line 30.2, in which the contacts located inside it are moved into a well-defined switching position. The position of the handle plate 20 in FIG. 2 then assumes the operative position indicated by an additional auxiliary line 20.2. In this operative position 20.2, the aforementioned outer stops 21 have moved away from their outer opposing stops 11. The joint members 51 have swiveled and/or undergone sufficient deformation.

FIG. 4 shows an alternative to FIG. 2, in which a person operating the actuator of the invention has carried out an unsymmetrical actuation on the rectangular or square handle plate 20, as indicated by the arrow 29. As a result, the joint members 51 are swiveled and/or deformed in a different way. At one of the plate edges, an inner stop 22 comes to rest against an inner opposing stop 12 of the housing shell 10, while at the opposite plate edge the previously described outer stop 21 is supported on the housing-side inner opposing stop 12. As a result, the handle plate 20 assumes a well-defined inclined position, which is indicated in FIG. 4 by the auxiliary line 20.3. Even in this inclined position 20.3, these pairs of stops 11, 21 and 12, 22 cause the switching element 31 to be pushed in sufficiently by the bush-button switch 30 for the depressed effective switching position 30.2 to be reached again.

As mentioned above, FIGS. 5 to 7 show a second embodiment of the actuator of the invention. Analogous parts are again identified by the same reference numbers. Of the shell housing 10, only the shell base 15 and the strips 18 that serve to bound the shell opening are illustrated. The shell base is provided with recesses 19.

One difference is that the push-button switch 30 with its switch housing 32 is mounted on the rear side 23 of the plate, in this case essentially in the center 26 of the plate. The switch suspension 33 is directed towards the shell base 15 here, towards which the switching element 31 is then also directed. In this case as well, the switch suspension 33 provides a reactive force 34 of the handle plate, as indicated by a force arrow, and the handle plate 20 is then kept in the previously described rest position, which is indicated here by an analogous auxiliary line 20.1.

As FIG. 6 illustrates, in this case as well, the handle plate 20 has strip-like extensions 42 at opposite edge regions 27 of the plate, which are overlapped towards the visible side by opposing extensions 35 of the strips 18 that enclose the opening. The extensions 42 and the opposing extensions 35 are produced here by stepped reductions of the plate thickness and the housing wall. As is better seen in FIG. 6, the facing flat parts of the extensions 42, on the one hand, and of the opposing extensions 35, on the other hand, form the outer stops 21 and the outer opposing stops 11, which, in the rest position 20.1 of FIG. 5, support each other due to the reactive force 34 of the switch suspension 33. However, this support is accomplished indirectly by interposition of regions of a special joint member 52.

Like the joint member 51 of FIGS. 1 to 4, the joint member 52 consists of an elastomeric material and in the present case has an S shape. While, as FIG. 5 shows, the inner S-sidepiece 55 is situated behind the inner surface 23 of the plate, the outer S-sidepiece 56 overlaps the visible side 25 of the handle plate 20. The S-crosspiece 57 is then located between the stop surfaces 21, 11 described above.

In FIG. 6, as indicated by arrow 28, the handle plate 20 is again actuated symmetrically and is pushed into the housing interior 14 against its reactive force 34. This actuation 28 occurs in the central region of the handle plate 20. This can lead to bending and possibly elongation of the S-crosspiece 57 of the joint members 52, as illustrated in FIG. 6. However, even in this case, the switch suspension 33 is the critical force that must be overcome by the actuating force 28. FIG. 6 shows the operative position 20.2 of the handle plate 20 that was described earlier in connection with the first embodiment of the actuator of the invention. The switching element 31 in FIG. 5 has been moved from its extended position 30.1 in FIG. 5 into the depressed position indicated by the auxiliary line 30.2 in FIG. 6. The contacts in the switch housing 32 have been reswitched in the process.

Figure 7:
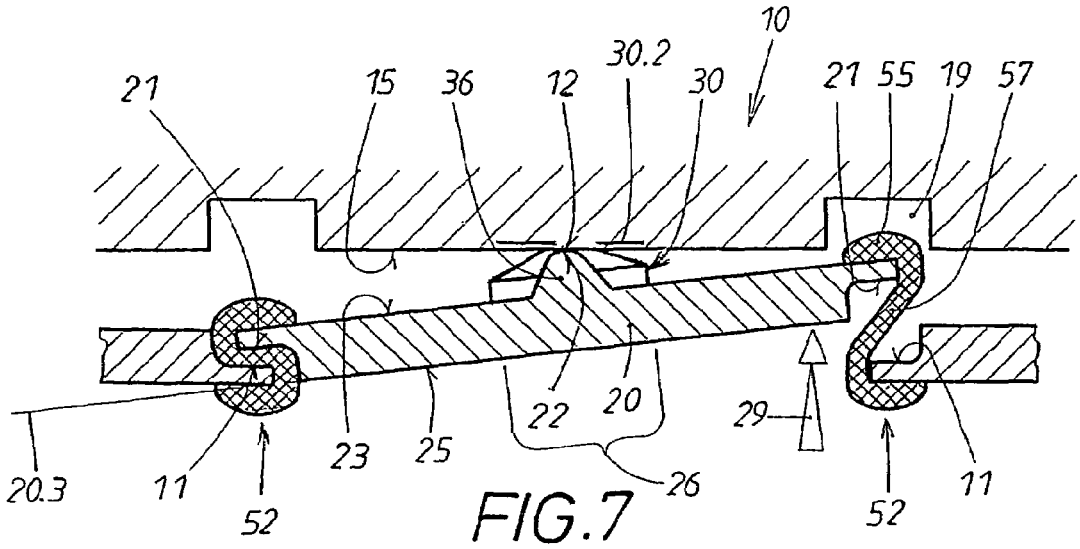
FIG. 7 shows the actuator of FIG. 6 when the handle plate has been unsymmetrically actuated and has assumed a well-defined inclined position.

As in the case of FIG. 4, FIG. 7 shows the case in which the handle plate 20 in this second embodiment is unsymmetrically actuated, as indicated by arrow 29. While the outer stops and opposing stops 21, 11 move away from each other on one side, accompanied by further deformation and possibly elongation of the S-crosspiece 57 of the joint member 42, they remain in contact with each other on the opposite side. On the side on which elongation occurs, the recess 19 in the shell base 15 ensures that the inner S-sidepiece 55, which is situated behind the rear surface 23 of the plate, does not act as a stop for the tilting of the handle plate 20. At the same time, an inner stop 22 on the rear side 23 of the plate comes into contact with an inner opposing stop 12 formed by the shell base 15. For this purpose, a cam 37 is provided on the rear side in the center 26 of the plate. The tip of the cam forms the inner stop 22. The cam 37 is located in the area of the push-button switch 30 and is shaped in such a way that, in this case as well, the handle plate 20 reaches a well-defined inclined position 20.3, in which the switching element 31 again reliably moves into its depressed position 30.2. In addition, the cam 37 prevents the switching element from being pushed in too far and prevents excessive stress on the push-button switch 30, which could lead to permanent switch damage.

Figure 8:
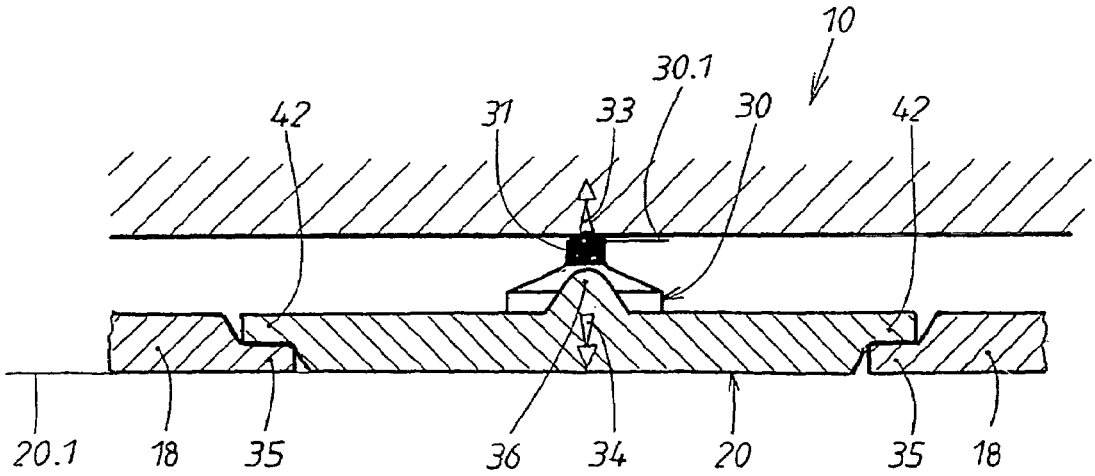
FIG. 8 shows, in a view corresponding to FIG. 5, a modified third embodiment of the invention with the handle plate in its rest position.

The third embodiment of FIG. 8 has a design similar to that of the second embodiment of FIGS. 5 to 7. To this extent, therefore, the previous description also applies here. The difference between the actuator shown in FIG. 8 and the actuator of the preceding case consists mainly in the absence of any joint members. FIG. 8 shows the rest position 20.1 of the handle plate 20, in which the reactive force 34 produced by the switch suspension 33 ensures that the plate-side extensions 42 are supported on the housing-side opposing extensions 35 and thus form the aforementioned outer stops and opposing stops 21, 11. Naturally, the switching element 31 is then again located in its extended position 30.1. The transfer into the operative position or into the inclined position of the handle plate 20 is then effected in this third embodiment in a manner similar to that shown in FIGS. 6 and 7, respectively.

LIST OF REFERENCE NUMBERS

10 housing shell
11 outer opposing stop in 10
12 inner opposing stop in 10 (FIGS. 4, 7)
13 shell opening
14 shell interior of 10
15 shell base of 10
16 center of the shell base 15
17 edge region at 13, edge of opening
18 strip at 13
19 recess in 15 (FIGS. 5, 7)
20 handle plate
20.1 rest position of 20 (FIG. 1)
20.2 operative position of 20 (FIG. 2)
20.3 inclined position of 20 (FIG. 4)
21 outer stop on 20
22 inner stop on 20 (FIG. 4)
23 rear side of plate 20
24 prominence with spherical profile at 26
25 visible side of 20 (FIG. 5)
26 center of plate 20
27 edge region of 20
28 force arrow of symmetrical actuation of 20 (FIG. 2)
29 force arrow of unsymmetrical actuation of 20 (FIG. 4)
30 push-button switch
30.1 extended position of 30 (FIG. 1)
30.2 depressed position of 30 (FIGS. 2, 4)
31 switching element of 30
32 switch housing of 30
33 switch suspension for 31
34 reactive force of 20 on 33 (FIG. 6)
35 opposing extension of 18 (FIG. 5)
36 cam on 23
41 U-shaped extension of 20 (FIGS. 1 to 3)
42 stepped extension of 20 (FIG. 6)
43 outer U-sidepiece of 41 (FIG. 2)
44 inner U-sidepiece of 41 (FIG. 2)
45 U-crosspiece between 43 and 44 of 41
51 joint member, web with double-U shape (FIG. 2)
52 joint member with S shape (FIG. 5)
53 first recess in 51 for 18
54 second recess in 51 for 27
55 inner S-sidepiece of 52 (FIG. 5)
56 outer S-sidepiece of 52 (FIG. 5)
57 S-crosspiece of 52 (FIG. 5)

The invention claimed is:

1. Actuator for an electric push-button switch (30), particularly in motor vehicles, with a housing shell (10) with a shell opening (13) for holding the push-button switch (30), with a handle plate (20) aligned with the switch opening (13) for manual actuation (28), with a handle suspension for pushing the handle plate (20) back into an outer, unactuated rest position (20.1), with outer stops (21) on the handle plate (20), on the one hand, and outer opposing stops (11) on the housing shell (10), on the other hand, which determine the outer rest position (20.1) of the suspended handle plate (20), wherein the handle plate (20) is movable back into an inner operative position (20.2) when actuated (28) against its handle suspension, with a pressure-actuated switching element (31) on the switch housing (32), which is pushable out by a switch suspension (33) into an extended position (30.1), wherein, in the extended position (30.1), the handle plate (20) is in its rest position (20.1), and the contacts in the push-button switch (30) are in a first switching position, and when the handle plate (20) is actuated (28), the switching element (31) moves against its switch suspension (33) into a depressed position (30.2), in which its contacts are in a second switching position, wherein the switch suspension (33) of the push-button switch (30) is simultaneously the handle suspension for the handle plate (20), which causes the unactuated handle plate (20) to be held by the switch suspension (33) of the push-button switch (30) in its outer rest position (20.1), in which the outer stops (21) of the handle plate rest on the outer opposing stops (11) of the housing shell (10), and that the handle plate (20) has inner stops (22) and the housing shell (10) has inner opposing stops (12), which, when the handle plate (20) is unsymmetrically actuated (29), cause the handle plate (20) to assume an inclined position (20.3) in such a way that the switching element (31) of the push-button switch (30) is nevertheless moved by the handle plate (20) into its depressed effective contact position (30.2).

2. Actuator in accordance with claim 1, wherein, besides the inner stops (22) and the inner opposing stops (12), at least one of the outer stops (21) and outer opposing stops (11) is involved in controlling the effective contact inclined position (20.3) of the handle plate (20).

3. Actuator in accordance with claim 1, wherein the outer stop (21) and/or the inner stop (22) are arranged in the edge region (27) of the handle plate (20).

4. Actuator in accordance with claim 3, wherein at least three outer stops (21) and/or inner stops (22) are arranged in the edge regions of the handle plate (20).

5. Actuator in accordance with claim 3, wherein the outer stop (21) and/or the inner stop (22) are arranged all around, in all edge regions of the handle plate (20).

6. Actuator in accordance with claim 1, wherein the outer opposing stops (11) are arranged in the edge region (17) of the edge of the opening.

7. Actuator in accordance with claim 1, wherein the inner opposing stops (12) are formed by the shell base (15) of the housing shell (10).

8. Actuator in accordance with claim 1, wherein, in the edge region (27) of the handle plate (20) there is an extension (41, 42), whose shoulder pointing in the direction of the switch suspension forms the outer stop (21), and that a strip (18) that bounds the shell opening (13) or a section of the strip overlaps the extension (41, 42) of the handle plate (20) and produces the outer opposing stops (11).

9. Actuator in accordance with claim 8, wherein the rear side of the extension (41, 42) facing in the opposite direction from the switch suspension (33) forms the inner stop (22) of the handle plate (20).

10. Actuator in accordance with claim 8, wherein the extension has an L shape.

11. Actuator in accordance with claim 8, wherein the extension (41) has a U shape, one of whose U-sidepieces (43) is seated on the rear side (23) of the handle plate (20), while the end of the other U-sidepiece (44) forms the outer stop (21) of the handle plate (20), and that the inner stop (22) is formed by the rear side of a U-crosspiece (45), which joins the two U-sidepieces (43, 44).

12. Actuator in accordance with claim 1, wherein the switch housing (32) of the push-button switch (30) is seated on the shell base (15) of the housing shell (10), and that the switch suspension (33) of the switching element (31) acts on the rear side (23) of the handle plate (20).

13. Actuator in accordance with claim 1, wherein the switch housing (32) of the push-button switch (30) is seated on the rear side (23) of the handle plate (20), and that the switch suspension (33) of the switch element (31) acts on the shell base (15) of the housing shell (10).

14. Actuator in accordance with claim 12, wherein the push-button switch (13) is arranged in the center (26, 16) of the handle plate (20) or of the shell base (10).

15. Actuator in accordance with claim 1, wherein the handle plate (20) has a square or rectangular shape.

16. Actuator in accordance with claim 1, wherein the inner stop (22), which serves to control the effective contact inclined position (20.3), is arranged on the rear side in the center (26) of the handle plate (20).

17. Actuator in accordance with claim 16, wherein the inner stop (21) is designed as a cam (36), and that the inner opposing stop (12) is formed by the shell base (15) of the housing shell (10).

18. Actuator in accordance with claim 17, wherein the cam (36) is located in the area of the push-button switch (30).

19. Actuator in accordance with claim 1, wherein that at least one joint member (51, 52) is arranged between the edge (27) of the handle plate (20) and the edge (17) of the shell opening (13), and that when the handle plate (20) is actuated (28, 29), the joint member (51, 52) allows both symmetrical movement of the handle plate (20) from the rest position (20.1) into the operative position (20.2) and unsymmetrical movement into the inclined position (20.3).

20. Actuator in accordance with claim 19, wherein the joint members (51, 52) act in pairs on opposite sides of the edge (27) of the handle plate and of the edge (17) of the shell opening of the shell housing (10).

21. Actuator in accordance with claim 19, wherein the joint member (51, 52) consists of an elastomeric material.

22. Actuator in accordance with claim 21, wherein the joint member consists of a web (51) that is attached at one end to the edge (27) of the handle plate (20) and at the other end to the edge (17) of the opening of the housing shell (10).

23. Actuator in accordance with claim 22, wherein the ends of the web-like joint member (51) are injected on the handle plate (20) and/or on the shell opening (13) of the housing shell (10).

24. Actuator in accordance with claim 22, wherein the two ends of the elastomeric joint member (51, 52) have recesses (53, 54), which receive edge regions (27) of the handle plate (20) at one end and edge regions (17) of the housing shell (10) in the area of the shell opening (13) at the other end.

25. Actuator in accordance with claim 21, wherein the elastomeric joint member (51) has a double-U shape (53, 54).

26. Actuator in accordance with claim 19, wherein the joint members form a peripheral frame on the handle plate (20).

27. Actuator in accordance with claim 19, wherein the joint members (51) and the handle plate (20) and/or the housing shell (10) are produced in an injection-molding process by a two-plastic injection technique.

* * * * *